US006522089B1

(12) United States Patent
Duong et al.

(10) Patent No.: US 6,522,089 B1
(45) Date of Patent: Feb. 18, 2003

(54) ELECTRONIC BALLAST AND METHOD FOR ARC STRAIGHTENING

(75) Inventors: Canh Cong Duong, Salem, MA (US); Ronald Fiorello, Tewksbury, MA (US)

(73) Assignee: Orsam Sylvania Inc., Danvers, MA (US)

( * ) Notice: Subject to any disclaimer, the term of this patent is extended or adjusted under 35 U.S.C. 154(b) by 0 days.

(21) Appl. No.: 10/002,916

(22) Filed: Oct. 23, 2001

(51) Int. Cl.[7] ..... H05B 37/02
(52) U.S. Cl. ..... 315/308; 315/291; 315/307
(58) Field of Search ..... 315/224, 225, 315/247, 291, 307, 308

(56) References Cited

U.S. PATENT DOCUMENTS 5,623,187 A * 4/1997 Caldeira et al. ..... 315/307
5,939,835 A * 8/1999 Takeda et al. ..... 315/209 R
6,262,542 B1 * 7/2001 Kim et al. ..... 315/224
6,281,642 B1 * 8/2001 Konishi et al. ..... 315/308
6,340,870 B1 * 1/2002 Yamashita et al. ..... 315/308
6,437,519 B1 * 8/2002 Ito ..... 315/291

* cited by examiner

*Primary Examiner*—Don Wong
*Assistant Examiner*—Shih-Chao Chen
(74) *Attorney, Agent, or Firm*—Carlo S. Bessone

(57) ABSTRACT

A method and apparatus for controlling a lamp ballast having a DC-DC converter with first and second MOSFETs acting as switches alternately connecting a DC power source to a power transformer, with an output of the power transformer being connected to a DC-AC inverter driving the lamp. The first and second MOSFETs in the DC-DC converter are alternately opened and closed at a frequency that is swept repeatedly between predetermined minimum and maximum frequencies. A microcontroller-based feedback element determines instantaneous power consumption by the lamp and controls the MOSFETs through a pulse width modulator to continuously adjust a duty cycle of signals driving gates of the MOSFETs to maintain a desired level of power consumption.

19 Claims, 15 Drawing Sheets

ELECTRONIC BALLAST AND METHOD FOR ARC STRAIGHTENING

FIELD OF THE INVENTION

The present invention relates to an electronic ballast and a method for providing arc straightening to a discharge lamp. The invention may be particularly useful in connection with high-intensity discharge (HID) lamps powered from a universal input and/or a 277 V AC line.

BACKGROUND OF THE INVENTION

In the field of ballasts for HID lamps, it is known that operating at relatively high frequencies can produce any number of advantages including decreases in the size and weight of the ballast, as well as increases in lamp efficacy. A significant problem of high frequency ballasts is the acoustic resonance often introduced by the use of such a system, and the arc instabilities that can result therefrom.

The prior art illustrates a number of approaches to overcoming these problems. Among these, U.S. Pat. No. 5,623,187 to Caldiera et al. describes one known approach. As described in this reference, arc instabilities are accompanied by deformations in the arc which change the arc's length, which in turn is known to vary the conductance or impedance of the operating lamp. The Caldiera et al. reference also teaches the necessity of adjusting the modulation frequency of the signals sent to the lamp in order to minimize the effects of acoustic resonance.

SUMMARY OF THE INVENTION

It is an object of the present invention to provide a universal input voltage electronic ballast to reliably regulate lamp power.

It is a further object of the invention to provide arc straightening for mercury-free HID lamps to improve the luminous efficiency of such lamps.

It is a further object of the present invention to provide a microprocessor control circuit arrangement for programmable start of a universal voltage electronic ballast having an active power factor corrector and a DC-AC converter.

It is another object of the present invention to provide a microprocessor control circuit arrangement for programmable start of a universal voltage ballast having an inrush current limit circuit, an active power factor corrector and a DC-AC inverter.

It is another object of the present invention to provide a microprocessor control circuit arrangement for instantaneous power regulation and programmable start of universal voltage ballast having an inrush current limit circuit, an active power factor corrector, and a DC-AC inverter.

The present invention includes an improved method and apparatus for controlling the ballast for an HID lamp so that arc straightening may be obtained through a simplified approach based on power consumption.

The method provides for controlling a lamp ballast which includes a DC-DC converter with first and second switches which alternately connect an input side of the DC-DC converter to a high-voltage DC power source and ground, so as to drive a power transformer, with an output of the power transformer being connected to a DC-AC inverter which in turn drives the lamp.

The method includes the steps of alternately closing the first and second switches at a frequency which is swept repeatedly between predetermined minimum and maximum frequencies, determining a present level of power consumption by the lamp, and controlling the first and second switches so that a ratio of the time during which either of the switches is closed compared to a length of the cycle of opening and closing such switches is adjusted based on the determined present level of power consumption.

In order to determine the present level of power consumption, it is possible to sense the lamp voltage and the lamp current and multiply the two values. The results of this multiplication can be used to generate a power control signal whose level reflects the calculated power consumption. The power control signal can be provided to a pulse width modulator (PWM) which in turn controls a duty cycle of generated pulse width modulated signals that the PWM uses to drive the switches. The repetition rate at which the PWM switches the pulse width modulated signals may be determined by a variable frequency signal which is repeatedly swept between a predetermined minimum and predetermined maximum frequency. The PWM may receive as a further input a signal whose level is indicative of sensed primary current of the ballast.

The PWM therefore many receive as inputs the variable frequency signal, a power control signal indicative of power consumed by the lamp, and a sensed primary current signal. The nature of operation of the PWM is such that an increase in the level of either of the power control signal and the sensed primary current signal will tend to decrease the duty cycle of the pulse width modulated outputs of the PWM used to drive the switches. Similarly, an increase in the frequency of the swept frequency signal will tend to decrease the duty cycles.

The PWM may be designed so that the received power control signal is internally compared to a power reference signal to produce an error signal, with the error signal being compared to the sensed primary current signal to ultimately control be duty cycles of the PWM outputs used to control the switches. The switches may be power MOSFETs or IGBT switches, with the pulse width modulated outputs of the PWM being used to drive a gate drive transformer. The gate drive transformer in turn produces as outputs gate drive signals connected to the gates of the power MOSFETs.

BRIEF DESCRIPTION OF THE DRAWINGS

The present invention will be described in connection with the attached drawing figures, in which.

DETAILED DESCRIPTION OF THE PREFERRED EMBODIMENTS

Figure 1:
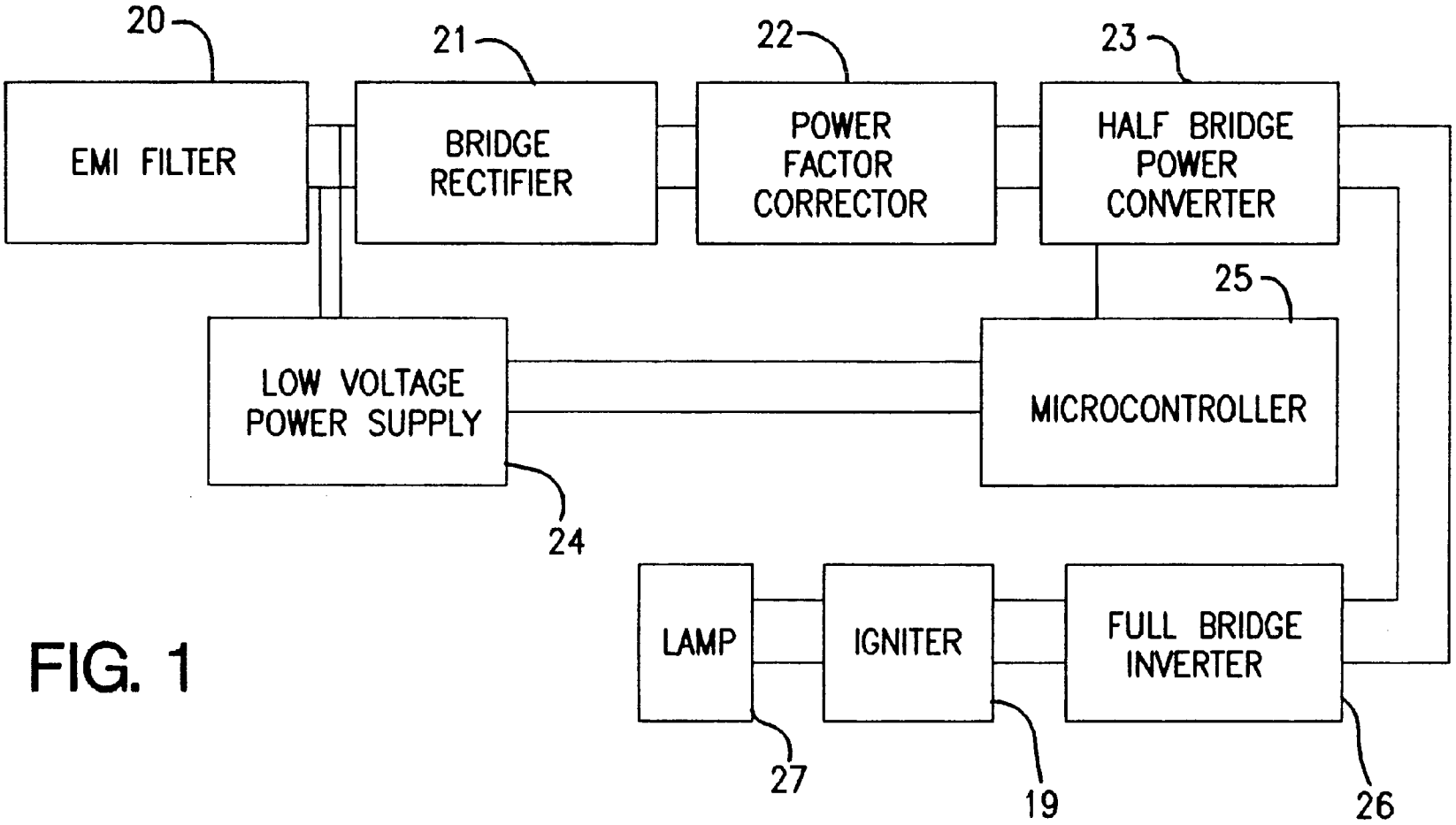
FIG. 1 is a schematic block diagram of the ballast.

As illustrated in FIG. 1, the ballast may include an electromagnetic interference (EMI) filter 20, which is connected sequentially to a bridge rectifier 21, a power factor corrector 22, and a half bridge DC-DC power converter 23. Also connected to the EMI filter 20 is a low voltage power supply 24 used to generate the appropriate power levels to supply the various logic devices in the ballast. Among the logic devices in the ballast is microcontroller 25 which is used to control the half bridge DC-DC power converter 23 and the full bridge DC-AC inverter 26. The full bridge DC-AC inverter is supplied by the half bridge power converter 23 and in turn ultimately drives the lamp 27.

Figure 2:
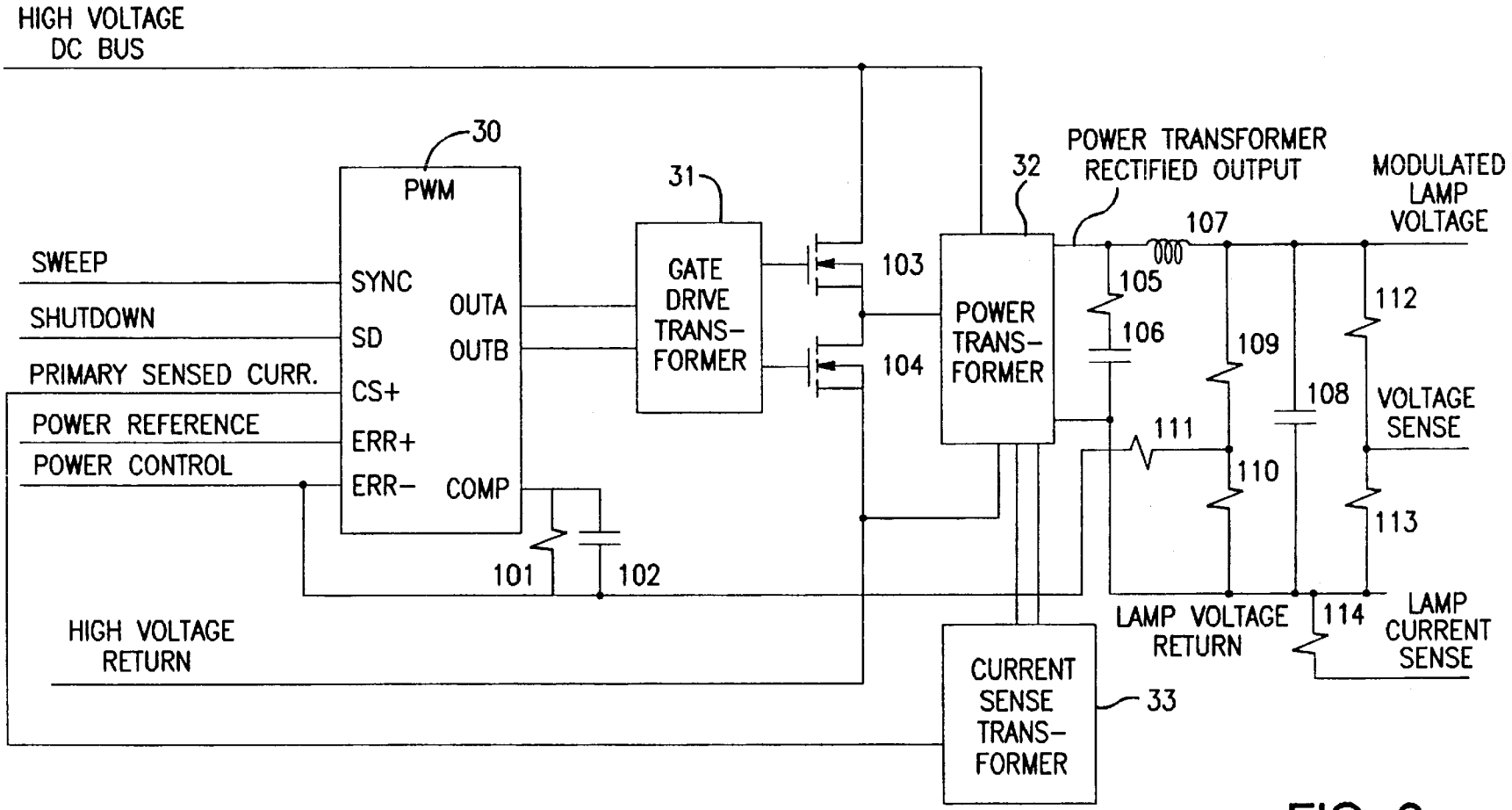
FIG. 2 is a circuit drawing of details of the DC-DC power converter.

Details of the half bridge DC-DC converter 23 are illustrated in FIG. 2. The half bridge DC-DC converter 23 is driven by a high-voltage DC bus produced by power factor corrector 22. The DC-DC converter 23 includes a pulse width modulator (PWM) 30, which receives a sweep signal at its SYNC input. A power control signal is received at an ERR−input, a power reference signal is received at an ERR+input, a sensed primary current signal is received at a CS+input, and a shutdown signal is received at an SD input.

The PWM 30 may drive a COMP output signal, which may in turn be fed back to the power control signal through a parallel connection of resistor 101 and capacitor 102 to provide frequency compensation for loop stability. PWM 30 also drives pulse width modulated outputs OUTA and OUTB, which are received as inputs by gate drive transformer 31.

The gate drive transformer 31 in turn drives the gates of power MOSFETs 103 and 104. The high-voltage DC bus is also connected to power transformer 32, which has an input tied to a point in the circuit connected to both power MOSFETs 103 and 104. Also connected to the power transformer 32 is current sense transformer 33. Current sense transformer 33 generates the sensed primary current signal received as an input by the PWM 30.

Power transformer 32 provides a rectified output, which is used to generate the modulated lamp voltage. The rectified output of power transformer 32 is connected to the lamp voltage return through a series connection of resistor 105 and capacitor 106, which operate as a snubber. An inductor 107 together with capacitor 108 are connected in series between the rectified output of the power transformer 32 and the lamp voltage return. Together, inductor 107 and capacitor 108 operate as a low pass filter. Values of 107 and 108 are selected so as to provide only minimal filtering.

Resistors 109 and 110 are connected in parallel to capacitor 108 to form a voltage divider. A point between resistors 109 and 110 is connected to the power control signal through resistor 111. Also parallel to capacitor 108 is a series arrangement of resistors 112 and 113. Together, resistors 112 and 113 operate as a voltage divider to produce a voltage sense signal from a point between the two resistors. Resistor 114 is connected to the lamp voltage return and is used to generate a current sense signal.

Figure 3:
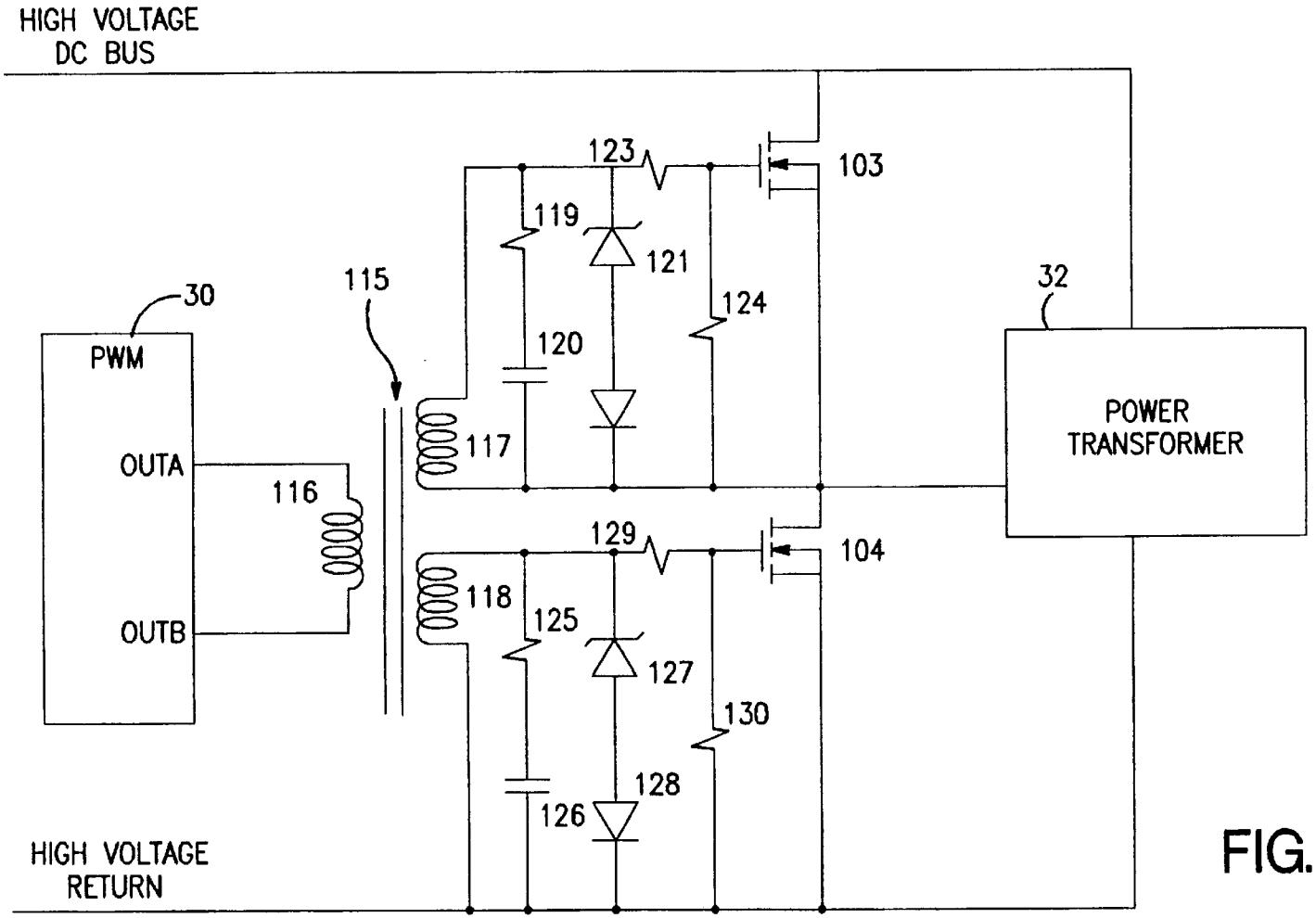
FIG. 3 is a circuit diagram illustrating details of the gate drive transformer.

Details of the gate drive transformer 31 are illustrated in FIG. 3. The signals driven by the OUTA and OUTB lines of the PWM 30 are connected to respective terminals of a primary 116 winding of the transformer 115. Across secondary winding 117 is a series arrangement of resistor 119 and capacitor 120, as well as a series arrangement of zener diode 121 and diode 122, connected anode-to-anode. Resistor 123 is connected between the cathode of the zener diode 121 and the gate of power MOSFET 103. Resistor 124 is connected between the gate of power MOSFET 103 and the cathode of diode 122. Between tertiary winding 118 and power MOSFET 104, resistor 125 and capacitor 126 are arranged in the same manner as are resistors 119 and capacitor 120. Zener diode 127 and diode 128 are arranged corresponding to zener diode 121 and diode 122. Resistors 129 and 130 correspond to resistors 123 and 124.

Figure 4:
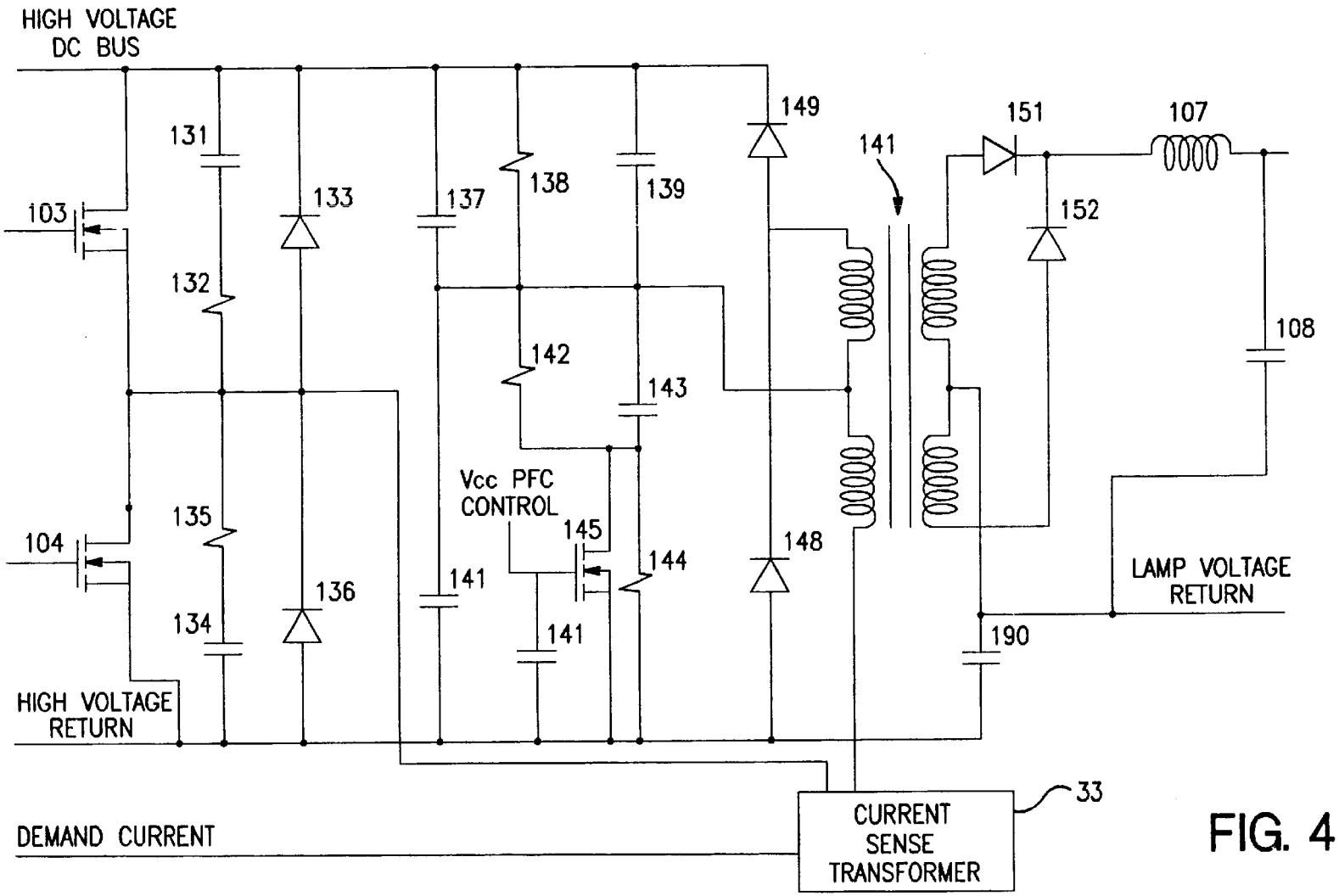
FIG. 4 is a circuit diagram illustrating details of the power transformer.

Details of power transformer 32 are illustrated in FIG. 4. Capacitor 131 and resistor 132 are arranged in series across the source and drain of power MOSFET 103. Diode 133 is also connected in parallel with power MOSFET 103. Capacitor 134, resistor 135, and diode 136 are arranged in connection with power MOSFET 104 in a manner corresponding to capacitor 131, resistor 132, and diode 133. Capacitor 137, resistor 138, and capacitor 139 are connected in parallel with one another between the high-voltage DC bus and a center tap of primary winding 140 of transformer 141. The center tap of primary winding 140 is connected through capacitor 141 to the high-voltage return. The center tap of winding 141, is also connected to a parallel combination of resistor 142 and capacitor 143, which are in turn connected through a parallel arrangement of resistor 144 and a MOSFET 145 to the high-voltage return. The gate of MOSFET 145 is connected through capacitor 147 to the high-voltage return, and is connected to Vcc PFC control generated as a DC voltage from the output of bridge rectifier 21. Together, MOSFET 145 and resistor 144 form an inrush current limiter.

The anode of a diode 148 is connected to the high-voltage return, and a cathode of diode 148 is connected to both a first terminal of primary winding 140 and an anode of diode 149. The cathode of diode 149 is connected to the high-voltage DC bus. The second terminal of primary winding 140 of transformer 141 provides a first input to the current sense transformer 33. A point between diodes 133 and 136 provides a second input to the current sense transformer 33. The transformer 141 includes a secondary winding 150, a first terminal of which is connected to the anode of diode 151. The second terminal of winding 150 is connected to the anode of diode 152. The cathodes of diodes 151 and 152 are connected together and provide the power transformer rectified output. A center tap of secondary winding 150 is connected to the lamp voltage return, as is connected through capacitor 190 to the high-voltage return.

Figure 5:
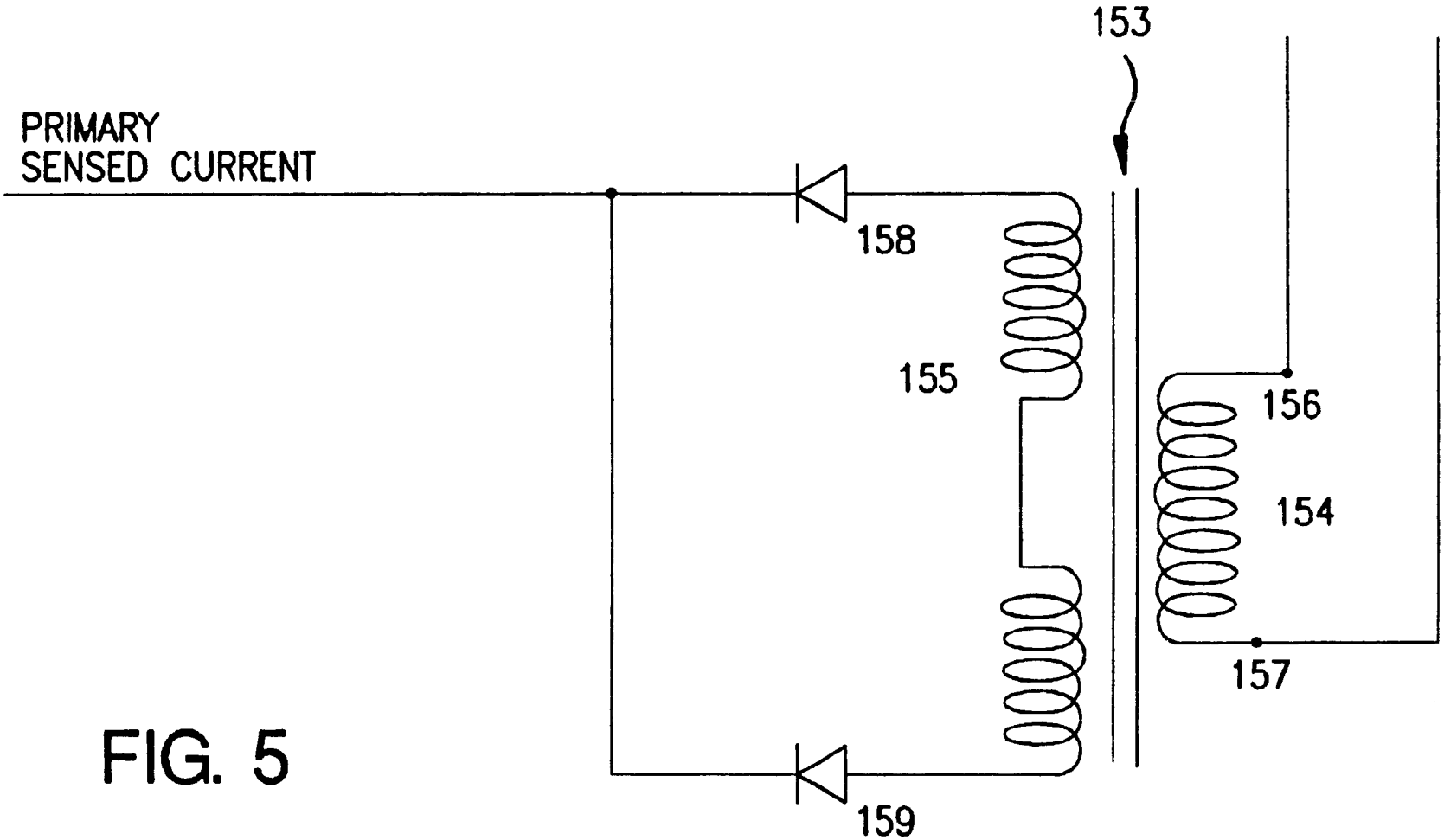
FIG. 5 is a circuit diagram illustrating details of the current sense transformer.

FIG. 5 illustrates details of the current sense transformer 33. Transformer 153 includes a primary winding 154 and a secondary winding 155. A first terminal 156 of primary winding 154 is connected to diodes 136 and 133 illustrated in FIG. 4. Second terminal 157 of primary winding 154 is connected to transformer 141 also illustrated in FIG. 4. The terminals of secondary winding 155 are connected to the anodes of diodes 158 and 159, respectively. The cathodes of diodes 158 and 159 are connected together to provide a rectified output which produces the sensed primary current signal.

The modulated lamp voltage provided by the power transformer 32 is supplied to the full bridge DC-AC inverter 26. Full bridge inverter 26 operates in a known manner to provide the necessary AC signal to drive the lamp 27.

Figure 6:
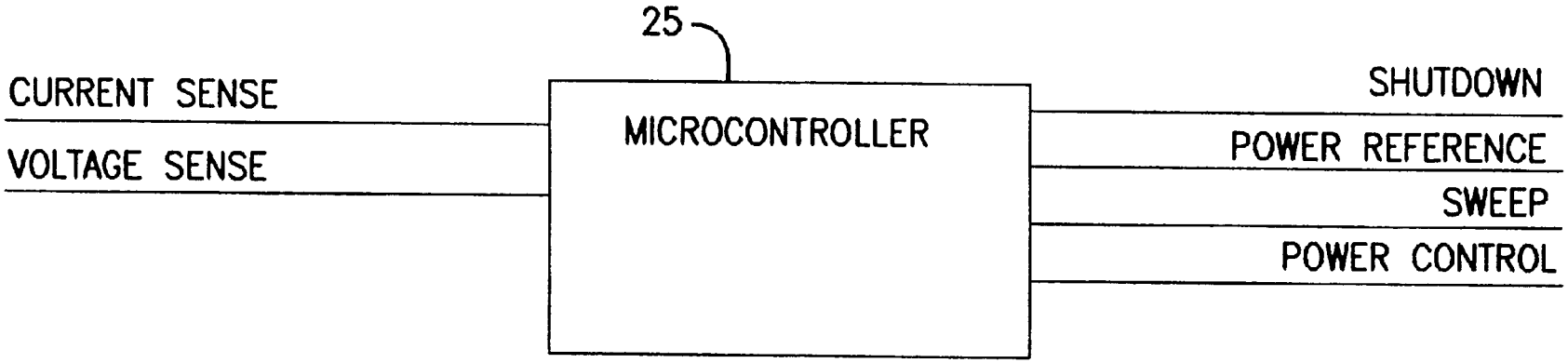
FIG. 6 is a block diagram showing inputs and outputs of the microcontroller.

FIG. 6 illustrates an overview of microcontroller 25. As shown, the microcontroller receives as inputs the voltage sense and current sense signals generated by the circuitry illustrated in FIG. 2. The microcontroller generates the outputs shutdown, power reference, sweep, and power control.

Figure 7:
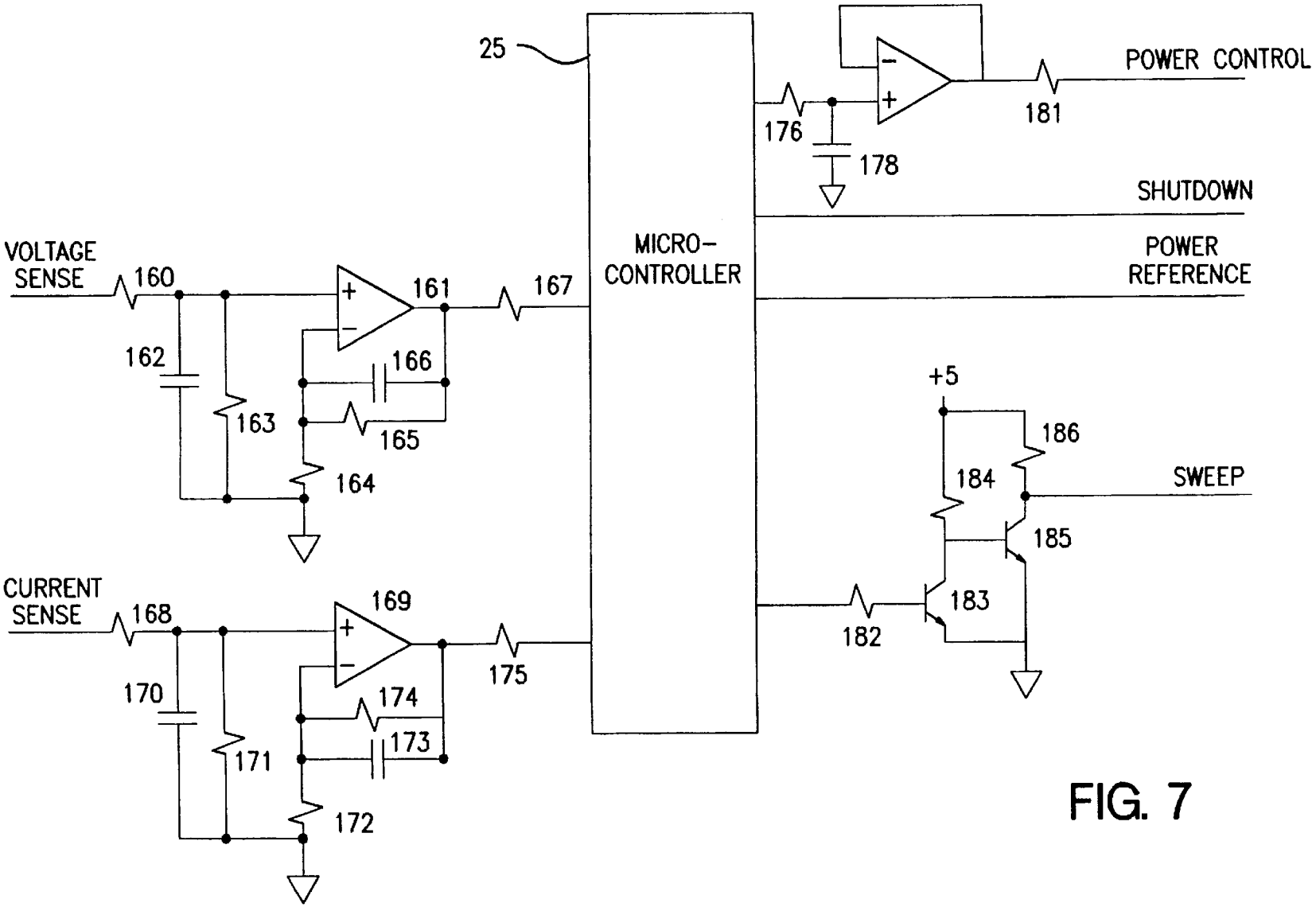
FIG. 7 is a diagram illustrating details of the circuits which drive inputs and outputs of the microcontroller.

FIG. 7 illustrates details of the microcontroller 25. The circuitry illustrated in FIG. 2 generates the voltage sense signal used by the microcontroller 25. The voltage sense line is connected through resistor 160 to the noninverting input of operational amplifier 161. The noninverting input is also connected through a parallel combination of capacitor 162 and resistor 163 to ground. The inverting input is connected through resistor 164 to ground. The inverting input is also connected to a parallel combination of resistor 165 and capacitor 166 to the output of operational amplifier 161, forming a differential voltage amplifier. The output of operational amplifier 161 is then connected through resistor 167 to an input of microcontroller 25.

The current sense line is connected through resistor 168 to the noninverting input of operational amplifier 169. The noninverting input is also connected through a parallel combination of capacitor 170 and resistor 171 to ground. The inverting input of operational amplifier 169 is connected through resistor 172 to ground. The inverting input is also connected through a parallel combination of capacitor 173 and resistor 174 to the output of operational amplifier 169, forming a differential voltage amplifier. The output of operational amplifier 169 is connected through resistor 175 to an input of microcontroller 25.

The power control signal generated by the microcontroller 25 is the output of a circuit in which an output pin of microcontroller 25 is connected through resistor 176 to the noninverting input of operational amplifier 177. The noninverting input is also connected through capacitor 178 to ground, forming a low pass filter. The inverting input of the operational amplifier 177 is connected to the output of the operational amplifier, forming a buffer amplifier. The operational amplifier 177 then generates the power control signal through resistor 181.

Microcontroller 25 generates the sweep signal by driving an output pin of the microcontroller through resistor 182 to the base of transistor 183. The collector of transistor 183 is connected to the 5V power supply through resistor 184 and is also connected to the base of transistor 185. The emitters of transistors 183 and 185 are connected together and also to ground. The collector of transistor 185 is connected through resistor 186 to the 5V power supply. The collector of transistor 185 also generates the sweep signal. This circuit is designed to provide sufficient current to the SYNC pin of the PWM.

The shutdown and power reference signals may be generated directly by the microcontroller 25 and are connected to PWM 30.

Operation of the present invention will now be described in connection with the various drawing figures.

FIGS. 3 and 4 illustrate details of the DC-DC converter 23. As illustrated in both figures, power MOSFETs 103 and 104 are connected respectively to the high-voltage DC bus and the high-voltage return. A point between the two MOSFETs is connected to power transformer 32. Viewing MOSFETs 103 and 104 as switches, by alternately closing the two switches, an AC signal is presented to the input of power transformer 32. Power transformer 32 uses this AC input to generate a rectified output which is then minimally filtered and supplied to be DC-AC inverter.

Throughout any single period of operation of MOSFETs 103 and 104, there are no times when both MOSFETs are turned on. There are, however, times when neither of the two MOSFETs is turned on. To a significant extent, operation of the lamp is controlled by the timings of the signals used to drive the gates of MOSFETs 103 and 104. The frequency of the pulse train driving the respective gates as well as the duty cycle of such pulses provide a mechanism for controlling how much power the lamp consumes.

Figure 8:
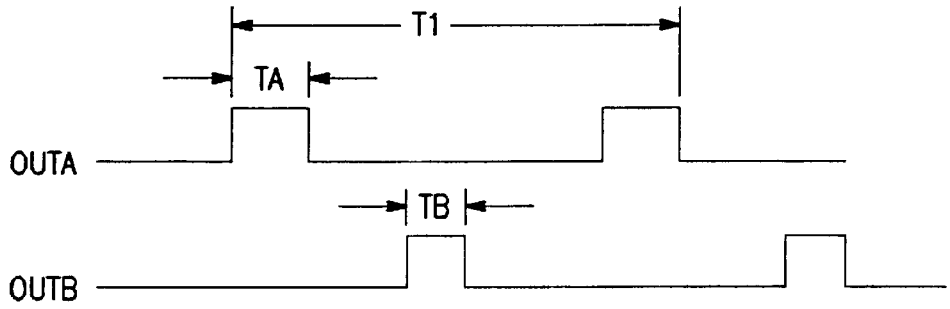
FIG. 8 is a waveform drawing illustrating the OUTA and OUTB outputs of the pulse width modulator.

FIG. 8 illustrates a waveform representation of the signals OUTA and OUTB. Each positive pulse results in a period during which one of MOSFETs 103 and 104 is enabled. T1 represents one complete cycle of the OUTA/OUTB pulse train sequence. TA and TB are the durations of the OUTA and OUTB pulses, respectively.

PWM 30 is designed to operate such that T1 matches the period of the sweep signal received at the SYNC input. This controls the overall frequency of OUTA and OUTB.

For the purposes of the present description, the duty cycle of OUTA and OUTB collectively is considered to be the sum of TA and TB with respect to T1. The duty cycle is controlled by the signals seen at the CS+, ERR−, and ERR+inputs of PWM 30. PWM 30 compares the levels of the power reference signal received at input ERR+and the power control signal received at input ERR−to produce an error signal at the COMP output. Internally, PWM 30 compares the error signal to the level of the sensed primary current signal present at the CS+input. The result of this comparison determines the duty cycle of the PWM outputs. The manner in which the present lamp ballast controls the DC-DC converter will now be discussed, first in connection with startup operation.

HID lamps are known to operate in two very distinct modes of operation, namely startup and steady state. When the lamp is cold, it requires a high start voltage, for instance 8,000 to 10,000 volts RMS. This high voltage creates a high intensity electrical field across the electrodes of the lamp, which initiates the discharge. As result, input power to the lamp during ignition is 5–10 times higher than the rated steady state lamp power. In any case, the lamp starting voltage depends on the inverter input voltage. For this reason, the manner in which the DC bus voltage is generated is critical to ensure that it is maintained within a known range as long as possible before the lamp ignites.

Through the circuitry illustrated in FIG. 7, microcontroller 25 generates the sweep signal. The sweep signal is received at the SYNC input of PWM 30. Microcontroller 25 also generates the power reference signal which, depending upon the present mode of operation of the lamp ballast, is either at a startup level or at a steady state level. The power reference signal is received by the PWM 30 at the ERR+ input.

While the lamp is starting up, the power reference signal is driven by microcontroller 25 as a series of pulses. As an example, the startup sequence may comprise a series of ten repetitions of alternating 2.5 second periods of a 5V level and a 0V level. Also during the startup sequence, microcontroller 25 drives the sweep signal at a frequency higher than is used during normal steady state operation of the lamp. This reduces the likelihood of magnetic saturation, and allows for a smaller magnetic core area.

For rapid lamp starting, it is required to provide an optimized DC bus voltage range for as long as possible to reduce the lamp starting interval. The shorter this interval is, the lower the stress imposed on ballast components. However, excessive start voltage caused by the DC bus voltage above this optimized range may saturate magnetic components and the resonant inductor in the inverter, resulting in high current and voltage stresses in inverter components. Therefore, the DC bus voltage range during inverter starting has to be optimized for worst case conditions with a programmed start sequence. This will help to improve lamp performance and prolong the life of the ballast.

Microcontroller 25 is programmed to generate the sweep signal as a frequency swept output. The frequency of the sweep signal repeatedly traverses a range between a predetermined maximum frequency and a predetermined minimum frequency. The upper and lower frequency limits are programmable to accommodate different lamp circuits. In one embodiment, the upper and lower limits of frequency are 60 kHz and 40 kHz, respectively. It is noted that a frequency of the resulting ripple in the voltage driving the lamp is twice the frequency of the sweep signal. The time for one complete cycle between minimum and maximum frequency may be 1 to 2 ms. The frequency modulation range and rate are determined by the arc tube dimensions, density of the gas fill, pressure, and other lamp parameters.

The range of frequency of the ripple on the voltage seen by the lamp, together with the amplitude of such ripple, contribute to the arc-straightening capabilities of the ballast. The modulated lamp voltage seen at the output of the low pass filter in the DC-DC converter includes both a DC component and an AC ripple. In one embodiment, the amplitude of the ripple is 25%–30% of the DC level. The amplitude of the ripple with respect to the DC component is determined by the low pass filter which, in the embodiment illustrated in FIG. 2, is implemented with inductor 107 and capacitor 108.

In one embodiment, the modulated lamp voltage includes a 100 V DC component and a 30 V ripple, resulting in a ripple between 85 V and 115 V. The voltage actually applied to the lamp by the DC-AC inverter would then alternate between DC levels of 100 V and−100 V with the same AC ripple superimposed thereon.

The relationship between the amplitude of the ripple as a percentage of the DC component and the value of the DC component itself is generally linear. Therefore, while an embodiment with a 100 V DC component would include 25–30 V of AC ripple, an embodiment designed to have a 50 V DC component would have ripple with amplitude in the range of 6.25 V to 7.5 V.

The microcontroller receives as inputs signals whose levels are indicative of the sensed voltage and current of the lamp. As illustrated in FIG. 2, these signal are driven by the circuit supplied with the power transformer rectified output. Microcontroller 25 is programmed to calculate present power consumption by the lamp as a product of the sensed voltage and current. The result of this calculation is reflected in the level of the power control signal. Microcontroller 25 could be implemented in the form of an 8-bit microprocessor with an internal hardware multiplier.

To some extent, the power control signal represents an averaging of a level of consumed power over some period of time. From an analog perspective, the signal is averaged by the RC combination of resistor 176 and capacitor 178 illustrated in FIG. 7. Additionally, microcontroller 25 itself may be programmed so that the output driven to resistor 176 represents an average value over some period.

While the power control signal is generated by microcontroller 25 and the related circuit illustrated in FIG. 7, the level of this signal is further influenced by its connection to the circuit that filters the rectified output of the power transformer. As illustrated in FIG. 2, resistors 109 and 110 provide a voltage divider between the modulated lamp voltage and the lamp voltage return. The point between resistors 109 and 110 is connected to the power control signal through resistor 111. In this way, the instantaneous value of the modulated lamp voltage may have an immediate effect on the level of the power control signal.

Microcontroller 25 also generates the power reference signal. As described above, this signal may comprise a pulse train while the lamp is starting up. During steady state operation, the power reference signal may be held at a constant level. In one embodiment, this level is approximately 1.1 V.

PWM 30 receives the power control signal at its ERR− input and compares the level of this signal to the level of the power reference signal received at PWM 30's ERR+input, using an error amplifier internal to the PWM. The resulting error output of the error amplifier may be output at the COMP output. Internally, PWM 30 compares the result of the calculated error with the level of the sensed primary current signal received at the CS+input.

The sensed primary current signal is generated by current sense transformer 33 illustrated schematically in FIGS. 2 and 4 and in detail in FIG. 5. Current sense transformer 33 is connected to the primary winding of transformer 141 of power transformer element 32 and provides a rectified output through diodes 158 and 159. The resulting sensed primary current signal will be a square wave with a ramp superimposed on the high level portions of the square wave, as illustrated in the example waveform of FIG. 9. The ramp portion on the wave is a result of the magnetizing current of transformer 141 of power transformer element 32 plus load current.

Figure 9:
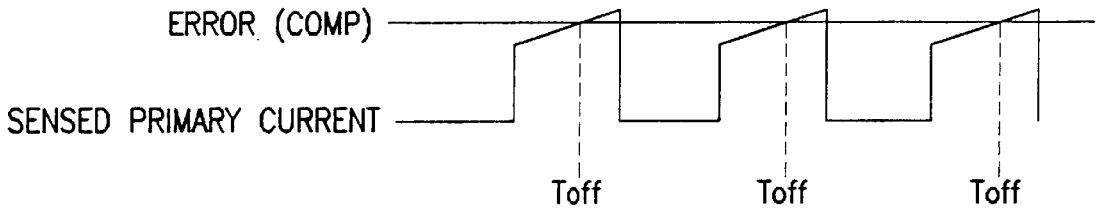
FIG. 9 is a waveform drawing of the sensed primary current signal according to the present invention.

Within PWM 30, the level of the sensed primary current signal is compared to the error signal driven by the error amplifier at the COMP output. As illustrated in FIG. 9, when the level of the ramp portion of the sensed primary current signal exceeds the calculated error level at time $T_{off}$, whichever of OUTA and OUTB is active at that time is driven inactive to shut off the corresponding one of MOSFETs 103 and 104.

Effectively, the error voltage present at the COMP output represents a current command signal and the sensed primary current is the signal output by the current transformer. The PWM compares these two signals. For example, as the error voltage at the COMP output increases the duty cycle is increased, resulting in increased output current.

PWM 30 uses the result of comparing the level of the sensed primary current signal with the calculated error signal to control the duty cycle of OUTA/OUTB. FIG. 8 illustrates a portion of a train of pulses on OUTA and OUTB. T1, the time for one complete cycle of pulses on OUTA and OUTB is determined by the present frequency of the sweep signal received by PWM 30 at the SYNC input. The overall duty cycle, considered as a sum of TA and TB with respect to T1, is controlled by PWM 30.

In general terms, as the duty cycle of OUTA/OUTB increases, power MOSFETs 103 and 104 conduct for a greater proportion of the cycle, and the lamp consumes more power. With respect to the influence of the sensed primary current signal and the power control signal, an increase in the level of either of these signals, with all other conditions being equal, will result in a decrease in the duty cycle of OUTA/OUTB. In this way, as PWM 30 receives an indication of an increase in power consumed by the lamp, the duty cycle is decreased to limit power consumption. Conversely, as a level of either of the power control signal and the sensed primary current signal decreases, the duty cycle of PWM increases. In this way, the feedback mechanisms provide for constant power output. The duty cycle is also influenced by the present value of the sweep signal. Given that OUTA and OUTB control how frequently and for how long power MOSFETs 103 and 104 provide a connection to high voltage and ground, respectively, the rectified output of power transformer element 32 has a frequency twice that of the OUTA/OUTB pulse train. The rectified output is minimally filtered and supplied to DC-AC inverter 26 so that a ripple with a frequency twice that of the sweep signal is superimposed on the AC signal driving the lamp.

With all other variables remaining constant, as the frequency of the sweep signal decreases, and necessarily the frequency of the ripple on the AC signal driving the lamp decreases proportionally, the duty cycle of OUTA/OUTB remains effectively constant.

The frequency of the sweep signal also affects the amplitude of the ripple on the AC signal which drives the lamp. As the frequency increases, the amplitude of the ripple decreases. The converse is also true, so that a decrease in the frequency causes an increase in the amplitude of the ripple.

The ripple present on the AC line which drives the lamp is an important element of the ability of the present invention to perform arc straightening. It has been discovered that it is possible to successfully achieve arc straightening by providing for a significant amount of ripple on the modulated lamp voltage, with the frequency of such ripple swept between predetermined minimum and maximum frequencies at a predetermined rate of sweep. These parameters of minimum and maximum sweep and rate of sweep can be determined in connection with characteristics of the lamp and can be designed so as to account for aging characteristics of the lamp.

For this reason, the characteristics can be encoded through the instructions executed by microcontroller 25 at the time of manufacture, with the ballast designed so that it is not necessary to have dynamic adjustment of the sweep parameters, as suggested by such references as Caldiera et al. discussed above. The hardware of the ballast is applicable to a wide range of lamps and conditions, with differences in software driving microcontroller accommodating differences in lamps. Further, the ballast could be designed such that the software could be updated to account for changes in lamp characteristics or applications.

Figure 10:
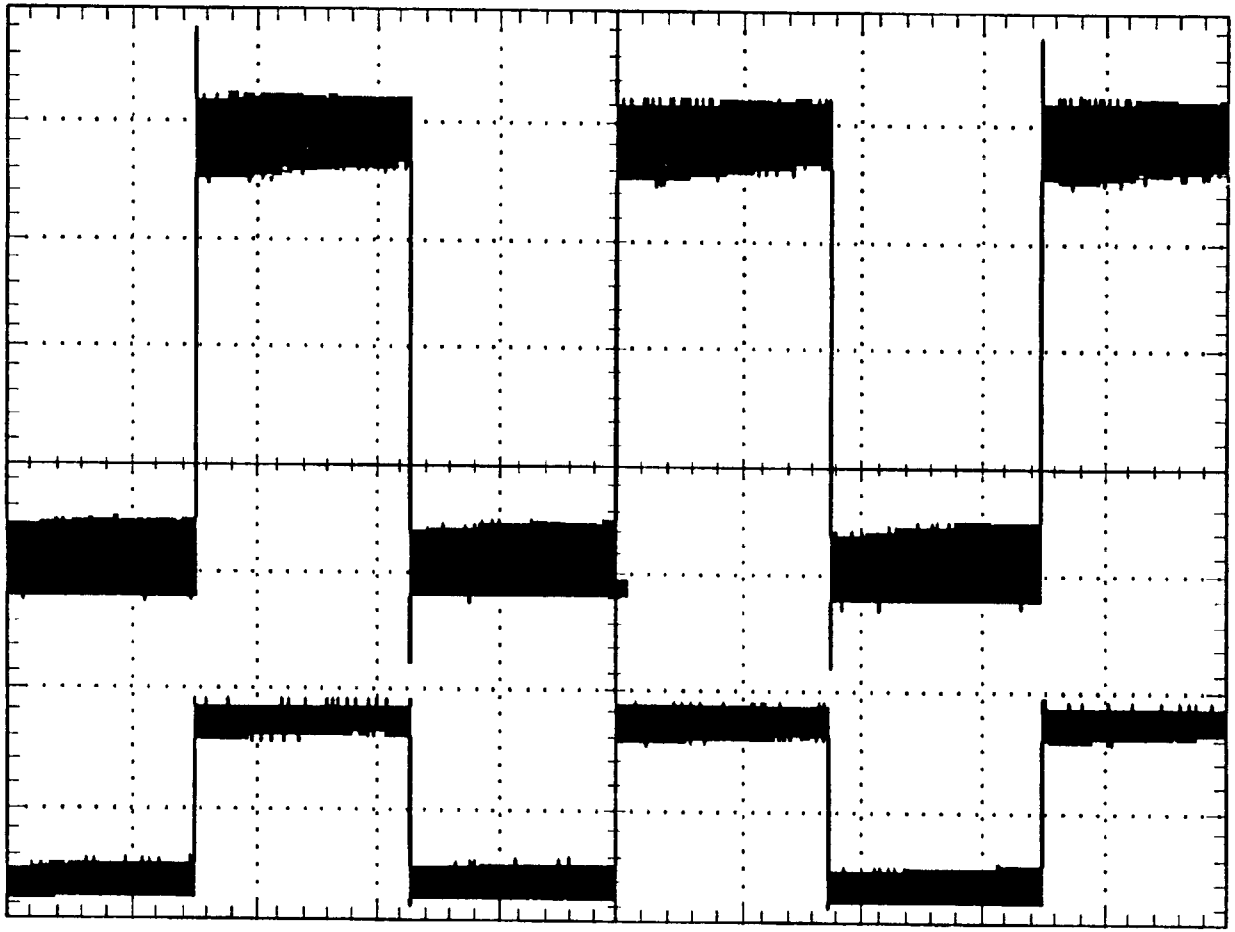
FIG. 10 is an illustration of sample voltage and current measured at the lamp being operated by a ballast according to the present invention.

FIG. 10 illustrates the voltage and current measured at the lamp as provided by DC-AC inverter 26 utilizing the ballast of the present invention. The upper trace is voltage on a scale of 50 V/division. The voltage seen at the lamp is approximately 210 V peak-to-peak with a ripple of approximately 30V. The lower trace is current measured at the lamp, shown at 5 A/division.

Figure 11:
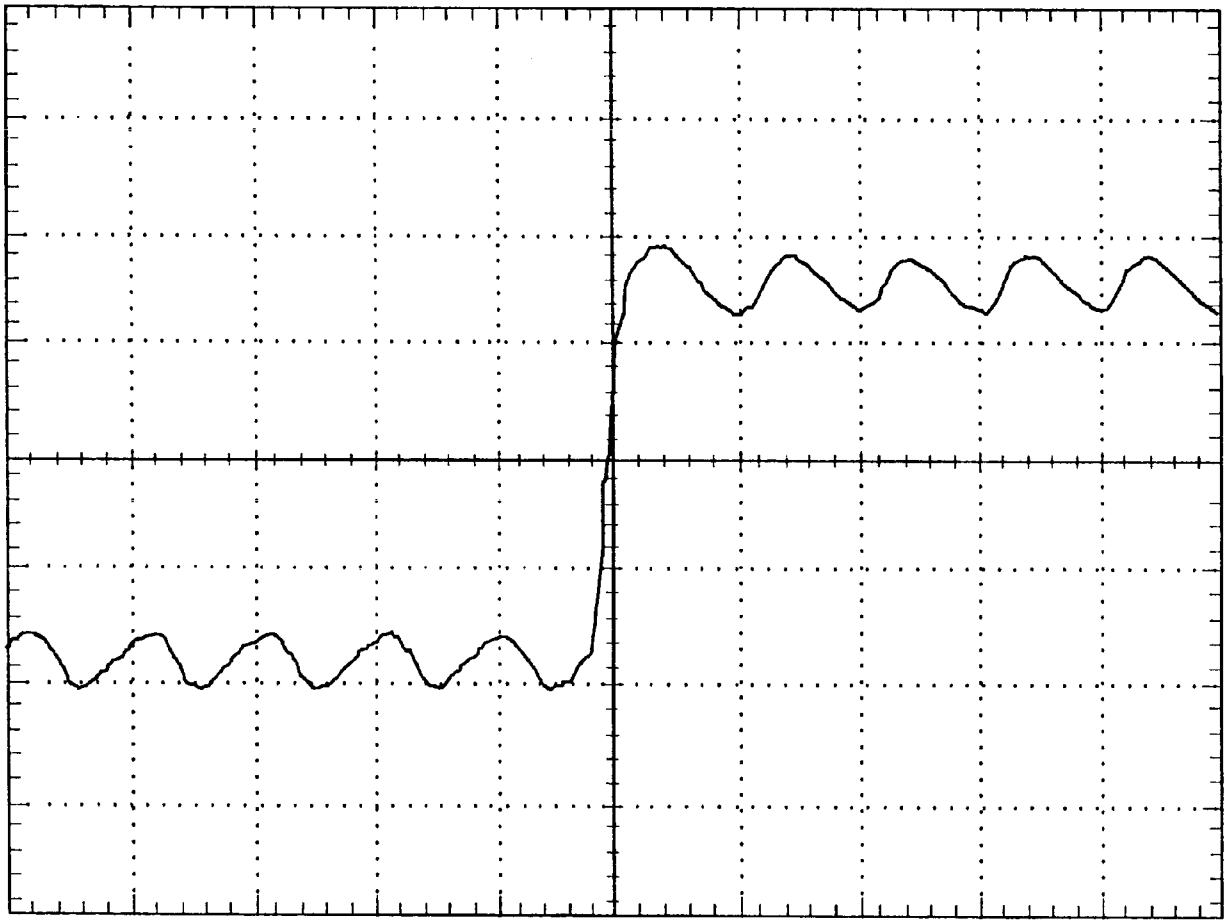
FIG. 11 is a waveform diagram showing details of ripple on the voltage waveform illustrated in FIG. 10.

FIG. 11 shows a waveform of the voltage illustrated in FIG. 10, but on a 50 V/division scale. In the illustrated range, the frequency of the ripple is approximately 50 kHz.

Figure 12A:
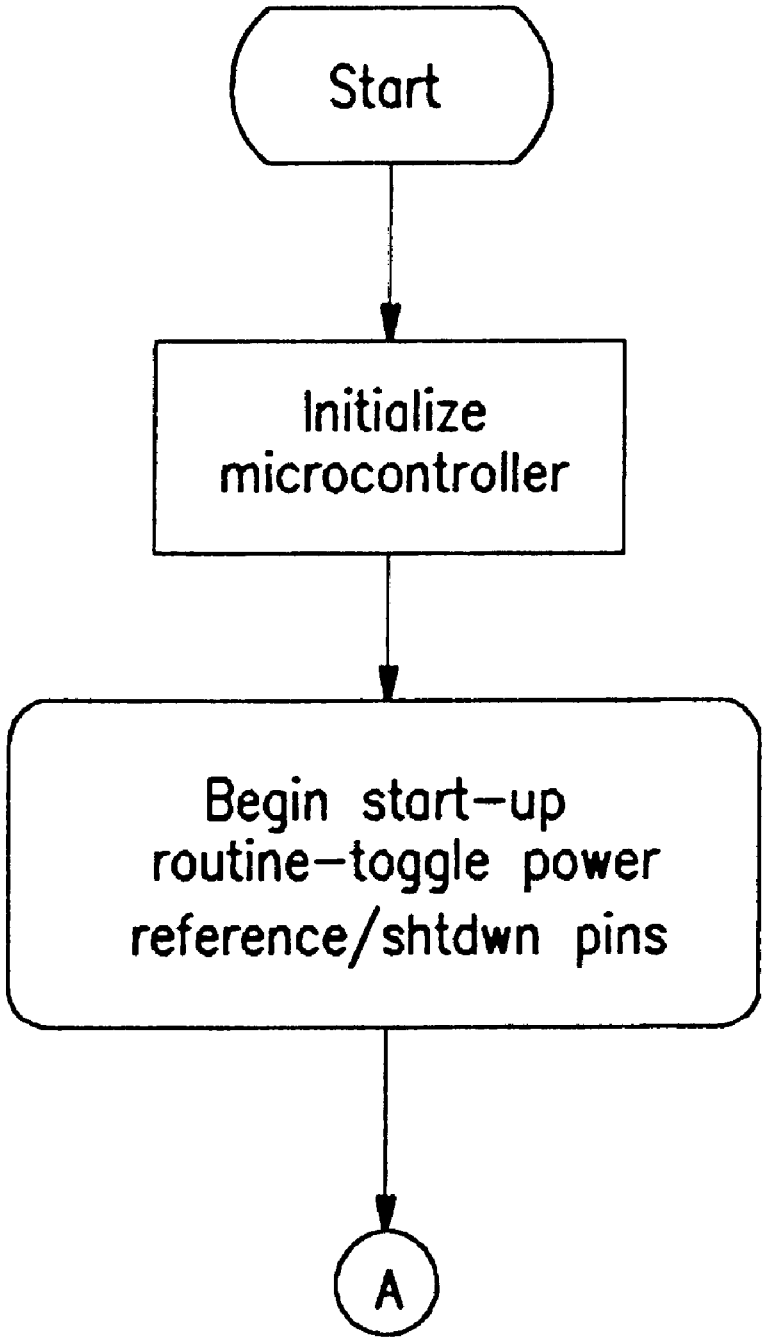
FIGS. 12*a*–12*e* illustrate a flowchart showing steps executed by the microcontroller according to the ballast of the present invention.

Overall operation of microcontroller 25 is illustrated in the flow chart of FIGS. 12*a* through 12*e* as shown in FIG. 12*a*, microcontroller 25 is initialized and begins the startup routine. This includes toggling the power reference and shutdown pins.

Figure 12B:
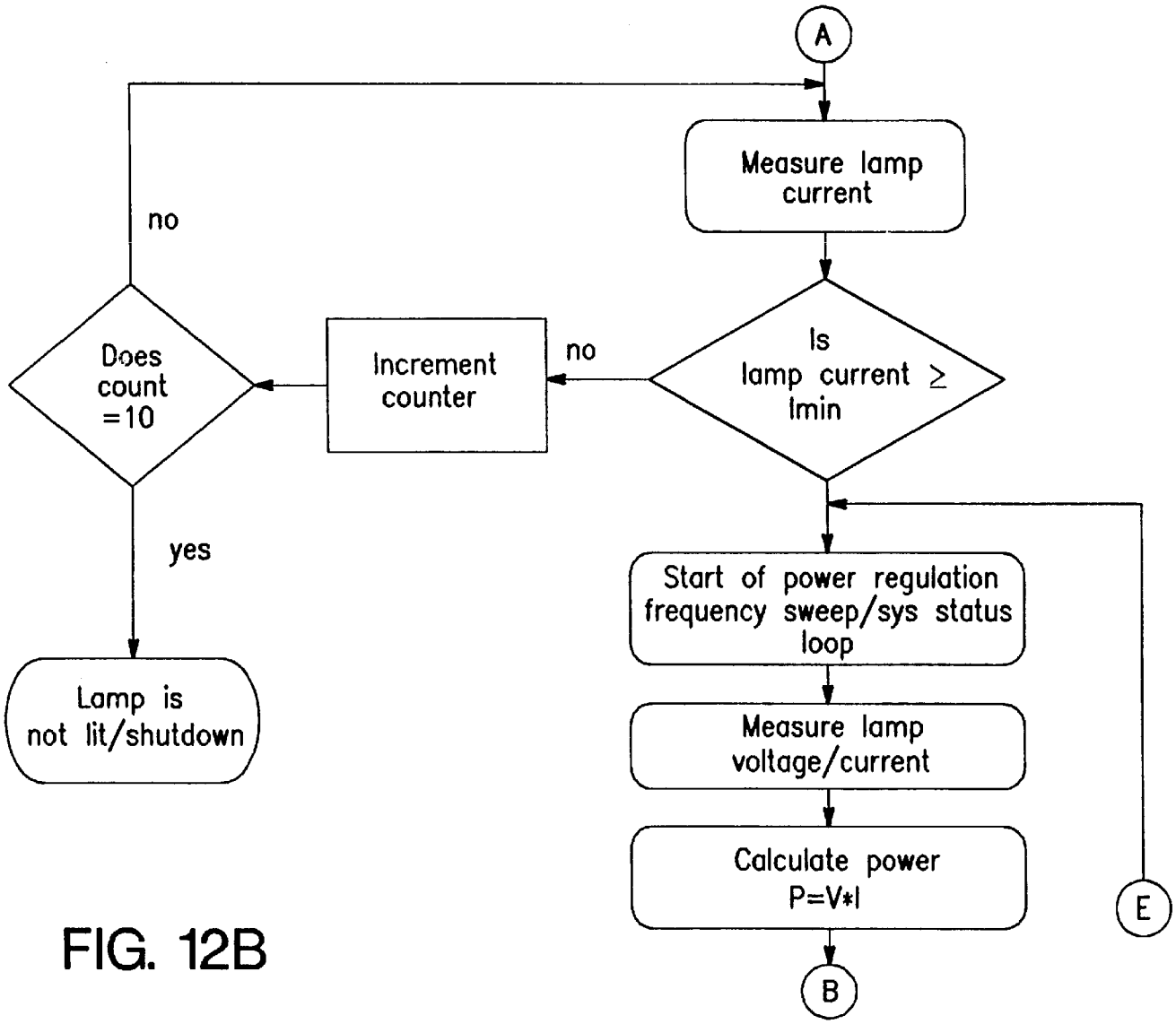
Figure 12C:
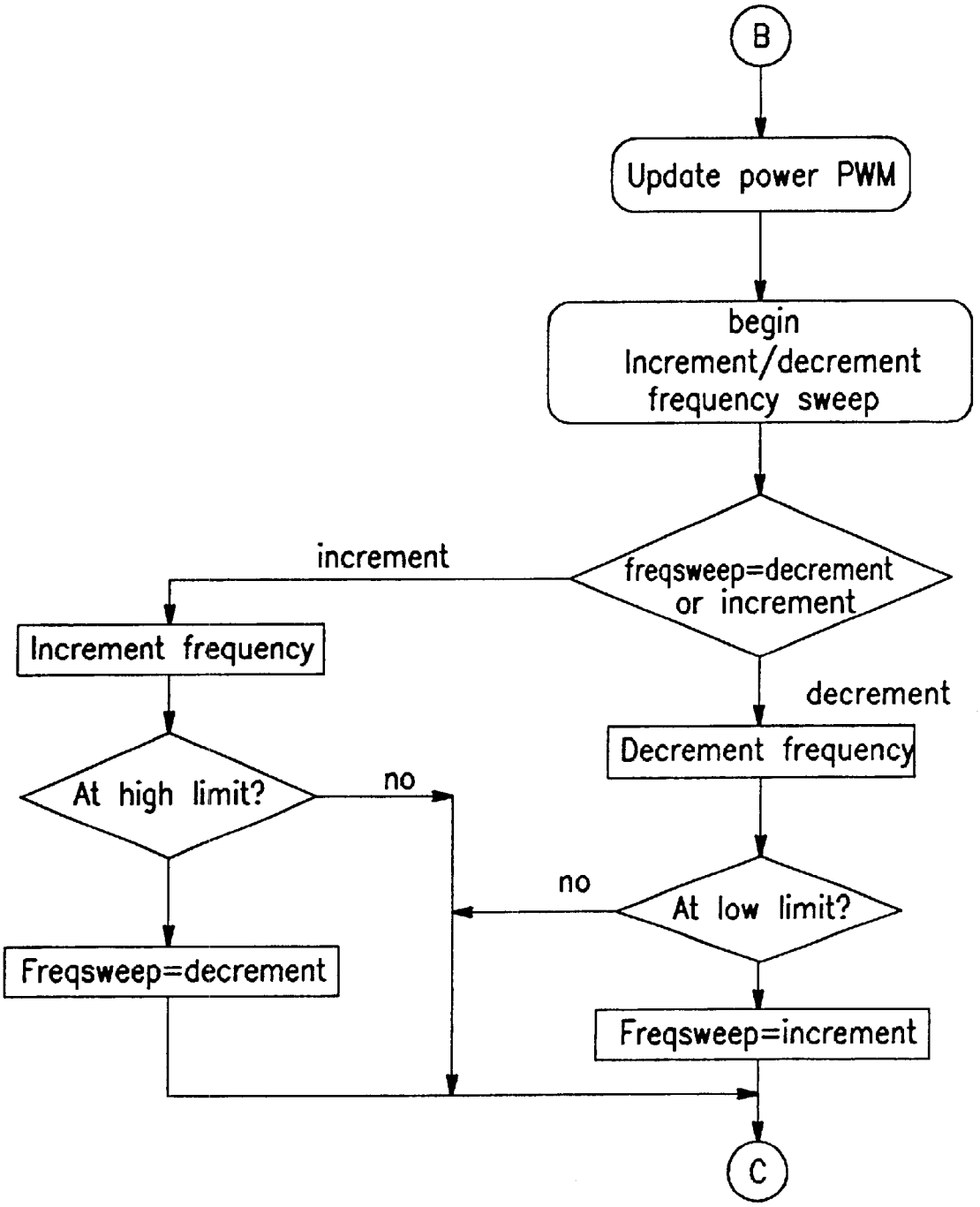

Continuing with the portion of the flow chart illustrated in FIG. 12*b*, microcontroller 25 measures lamp current. As described above, this measurement is performed by sampling the level of the signal present at the input of microcontroller 25 connected to the current sense signal. At the following decision block, microcontroller 25 determines whether the measured current is greater than a minimum value, represented as Imin. If the measured current is not greater than the minimum, a previously initialized counter is incremented and tested to determine whether is has reached a predetermined threshold. In the illustrated embodiment, this threshold is ten. The threshold allows for a number of iterations of the current check sequence to allow the measured current value to come into an acceptable range, so that if the limit has not yet been reached, the current may be checked again. Once the maximum number of tests of the current value has been reached and the measured current is still not greater than Imin, the shutdown pin is set to its active level. This sets the shutdown signal generated by microcontroller 25 to a level which is received by PWM 30 at its SD input, causing PWM 30 to cease generating pulses on OUTA and OUTB.

Once the current check loop has been exited by sensing a current at least as great as Imin, microcontroller 25 begins the power regulation frequency sweep/system status loop. Microcontroller 25 measures lamp voltage and current by sampling the levels of the signals at the inputs of microcontroller 25 which are driven by the voltage sense and current sense signals. Microcontroller 25 then calculates the present level of power consumption by multiplying the measured voltage and current levels. Based on the calculated power level, microcontroller 25 sets its output to update the level of the power control signal, which is received by PWM 30.

Microcontroller 25 then begins the increment/decrement frequency sweep. Microcontroller 25 checks whether a variable freqsweep is set to decrement or increment. If set to increment, microcontroller 25 increments the frequency, checks to see whether it is at its upper limit, and if so flips the value of freqsweep to decrement. If not yet at the limit, the execution path continues to the steps illustrated in FIG. 12*d*. If freqsweep was originally determined to be set to decrement, the frequency is decremented and checked to determine whether the frequency is at its lower limit. If so, the value of freqsweep is flipped to increment.

Figure 12D:
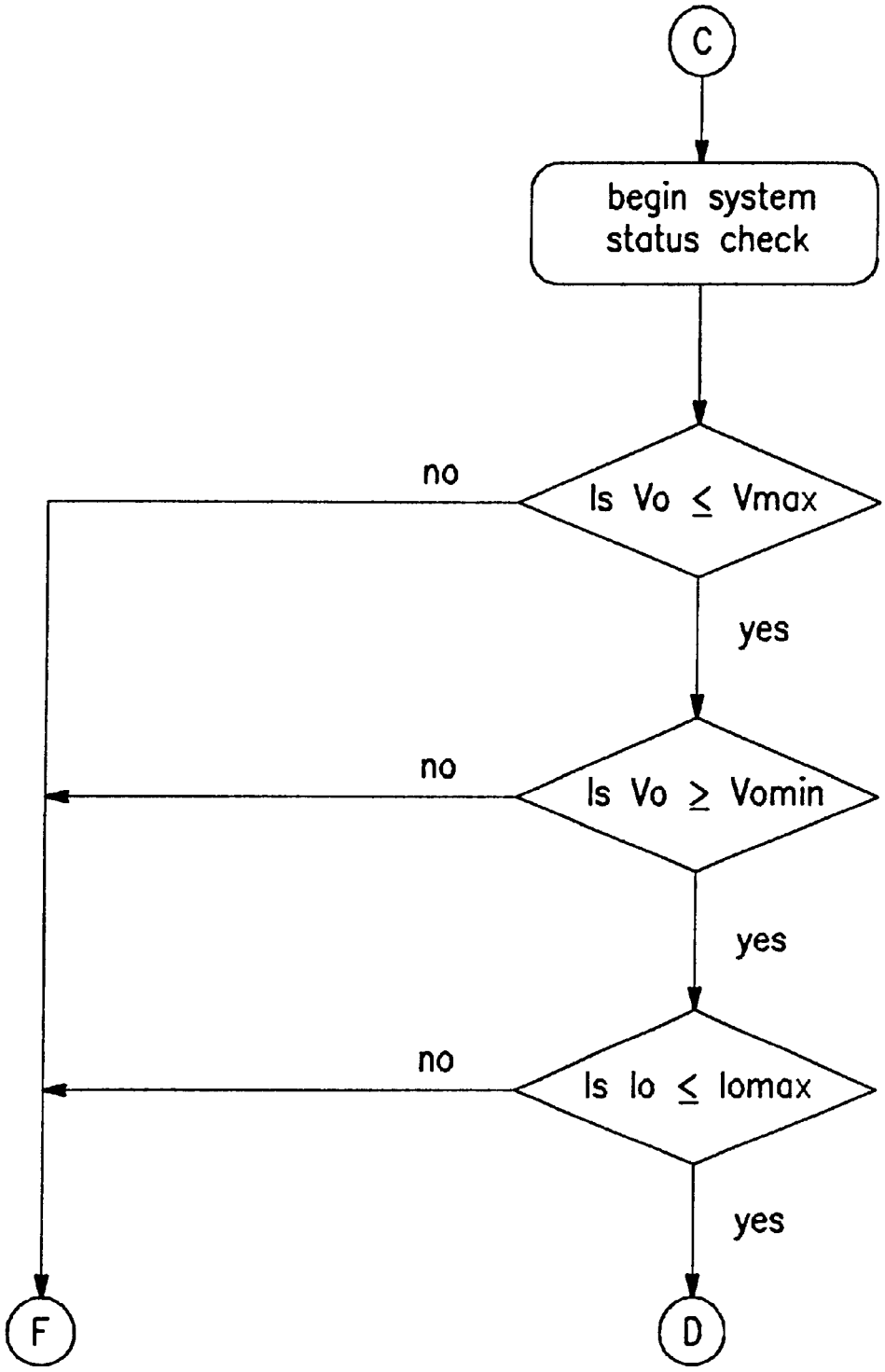
Figure 12E:
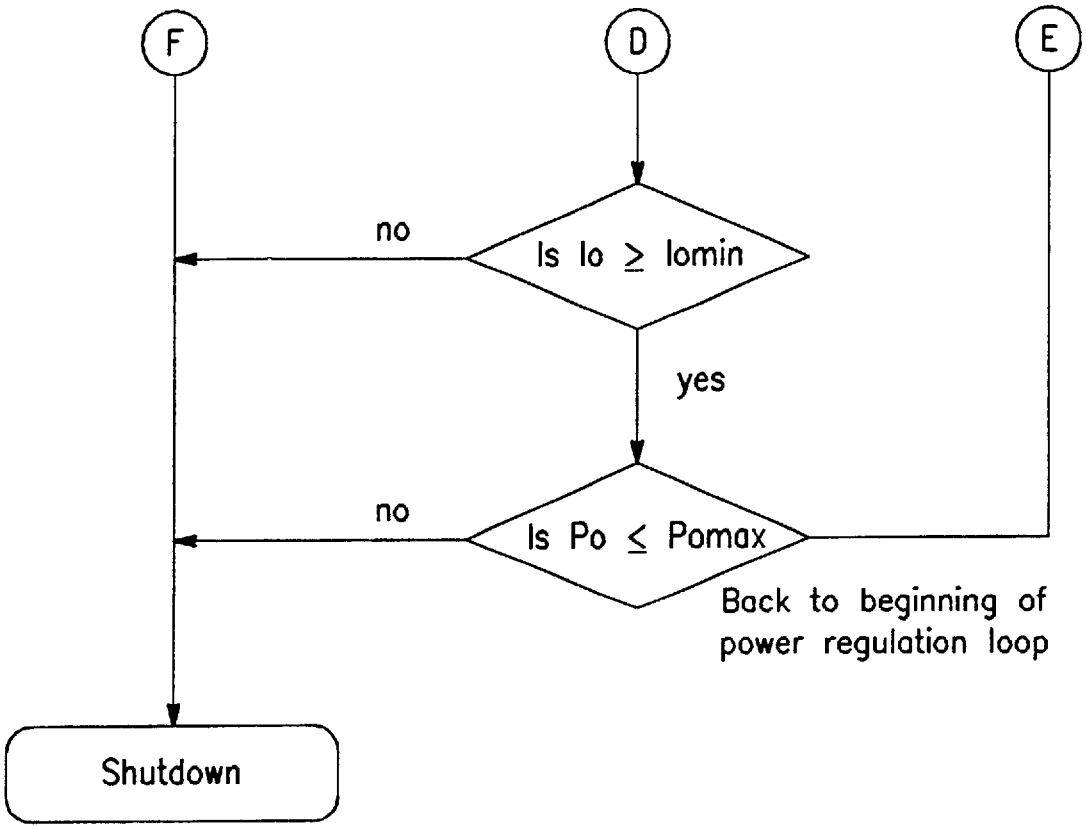

Beginning with FIG. 12*d*, microcontroller 25 begins a system status check by sequentially checking whether each of the measured voltage and the measured current is less than or equal to a predetermined maximum value and greater than or equal to a predetermined minimum value, as well as whether the calculated power is less than a predetermined maximum value. In the event that all of these conditions are satisfied, execution proceeds back to the beginning of the power regulation loop. In the event that any of these conditions is not met, microcontroller 25 sets the shutdown signal to cause PWM 30 to shutdown by ceasing to drive pulses on the OUTA and OUTB lines.

While the present invention has been described in connection with particular embodiments, it is to be understood that variations of the details described above are known to those of skill in the art, and are furthermore considered to be within the scope of the following claims.

We claim:

1. A method of controlling a lamp ballast which includes a DC-DC converter with first and second switches alternately connecting a DC power source to a power transformer, with an output of the power transformer being connected to a DC-AC inverter driving the lamp, the method comprising the steps of:

alternately closing the first and second switches in the DC-DC converter at a frequency which is swept repeatedly between predetermined minimum and maximum frequencies;

determining a present level of power consumption by the lamp; and controlling the first and second switches so that a ratio of a time during which either of the first and second switches is closed to a length of a cycle of opening and closing the first and second switches is adjusted based on the determined present level of power consumption.

2. The method of claim 1, wherein the step of determining the present level of power consumption by the lamp is performed by sensing a lamp voltage and a lamp current and calculating the power consumption by multiplying the lamp voltage by the lamp current.

3. The method of claim 2, wherein the determination of the present level of power consumption is performed by a logic device that produces a power control signal based on the calculated power consumption, the first and second switches being controlled by a pulse width modulator (PWM) which receives as an input the power control signal and generates pulse width modulated signals controlling operation of the first and second switches.

4. The method of claim 3, wherein the microcontroller further generates a variable frequency signal received as an input by the PWM, a frequency of the variable frequency signal being swept repeatedly between the predetermined minimum and maximum frequencies, the PWM controlling a frequency of the pulse width modulated signals based on the variable frequency signal.

5. The method of claim 4, wherein the PWM additionally receives as an input a primary sensed current signal.

6. The method of claim 5, wherein the PWM internally compares the power control signal to a power reference signal to produce an error signal, the PWM comparing the primary sensed current signal to the error signal to control a duty cycle of the pulse width modulated signals.

7. A lamp ballast comprising:

a DC-DC converter producing a lamp voltage, the DC-DC converter comprising first and second switches controlled by a switch control device;

an AC inverter receiving as an input the lamp voltage and producing as an output an AC voltage;

a lamp connector electrically connected to the output of the AC inverter; and a control section receiving as inputs a sensed voltage and a sensed current from the DC-DC converter and producing as an output a power control signal, a level of the power control signal being based on a product of the sensed voltage and the sensed current;

wherein the switch control device receives as an input the power control signal, and based on the level of the power control signal the switch control device adjusts timing of operation of the first and second switches.

8. The lamp ballast of claim 7, wherein the switch control device further receives as an input a primary sensed current signal from the DC-DC converter, and a variable frequency signal from the control section whose frequency is repeatedly swept between a fixed minimum frequency and a fixed maximum frequency, the switch control device being constructed to control timing of operation of the first and second switches by adjusting a duty cycle of each of first and second switch control signals generated by the switch control device.

9. The lamp ballast of claim 8, wherein the switch control device is a pulse width modulator (PWM), and wherein the PWM is constructed so that:

an increase in the level of the power control signal tends to cause a decrease in the duty cycle of the first and second switch control signals; and an increase in the level of the primary sensed current signal tends to cause a decrease in the duty cycles of the first and second switch control signals.

10. The lamp ballast of claim 7, wherein the switch control device is a pulse width modulator (PWM) which further receives as an input a variable frequency signal, a frequency of the variable frequency signal being repeatedly swept between a minimum frequency and a maximum frequency.

11. The lamp ballast of claim 10, wherein the PWM further receives as an input a primary sensed current signal, the PWM being constructed to compare the power control signal to a power reference signal to produce a error signal, the PWM comparing the primary sensed current signal to the error signal to control a duty cycle of each of first and second switch control signals generated by the PWM.

12. The lamp ballast of claim 11, wherein the first and second switches are power MOSFETs, the first and second switch control signals being connected to a gate drive transformer, the gate drive transformer producing as outputs first and second gate drive signals connected to gates of the first and second power MOSFETs, respectively.

13. The lamp ballast of claim 12, wherein the lamp voltage comprises a DC component and an AC ripple, an amplitude of the AC ripple being within a range of 25% to 30% of the DC component.

14. The lamp ballast of claim 7, wherein the lamp voltage comprises a DC component and an AC ripple, an amplitude of the AC ripple being within a range of 25% to 30% of the DC component.

15. A lamp ballast comprising:

a DC-DC converter producing a DC lamp voltage, the DC-DC converter comprising first and second switches controlled by first and second pulse width modulated signals generated by a pulse width modulator (PWM), wherein the lamp voltage includes a ripple;

an AC inverter receiving as an input the lamp voltage and producing as an output an AC voltage including the ripple of the lamp voltage;

a lamp connector electrically connected to the output of the AC inverter; and a control section receiving as inputs a sensed voltage and a sensed current from the DC-DC converter and producing as an output a power control signal, a level of the power control signal being based on a product of the sensed voltage and the sensed current, the control section also producing as an output a variable frequency signal whose frequency is repeatedly swept between a fixed minimum frequency and a fixed maximum frequency;

wherein the PWM receives as inputs a primary sensed current signal, the power control signal, and the variable frequency signal, the PWM generating the first and second pulse width modulated signals based on a frequency of the variable frequency signal, the PWM being configured to compare the power control signal to a power reference signal to produce an error signal, the PWM comparing the primary sensed current signal to the error signal to control a duty cycle of each of first and second pulse width modulated signals.

16. The lamp ballast of claim 15, wherein the amplitude of the ripple and the minimum and maximum frequencies of the variable frequency signal are selected so that during operation of the lamp, an arc produced within the lamp is maintained without making contact with a wall of a discharge vessel of the lamp.

17. The lamp ballast of claim 16, wherein the amplitude of the ripple is within a range of 25% to 30% of an amplitude of the DC component of the lamp voltage.

18. A lamp ballast comprising:

a DC-DC converter producing a lamp voltage;

an AC inverter receiving as an input the lamp voltage and producing as an output an AC voltage;

a lamp connector electrically connected to the output of the AC inverter;

a means for sensing lamp voltage;

a means for sensing lamp current;

a means for calculating present power consumption based on the sensed lamp current and the sensed lamp voltage;

a means for generating a variable frequency signal whose frequency is repeatedly swept between a fixed minimum frequency and a fixed maximum frequency;

a means for switching an input to the DC-DC converter;

a means for determining a primary current of the lamp; and a means for controlling the means for switching based on the variable frequency signal, the calculated current power consumption, and the primary current.

19. The lamp ballast of claim 18, wherein the means for controlling is a pulse width modulator (PWM) producing as outputs first and second pulse width modulated switch control signals, the PWM being constructed so that:

an increase in the primary current of the lamp tends to decrease a duty cycle of each of the first and second switch control signals; and an increase in the calculated present power consumption tends to decrease the duty cycles of the first and second switch control signals.

* * * * *